US007100618B2

(12) United States Patent
Dominguez

(10) Patent No.: US 7,100,618 B2
(45) Date of Patent: Sep. 5, 2006

(54) SENSORY SMOKING SIMULATOR

(76) Inventor: Armando Dominguez, Federal Satellite Low, 2650 Hwy. 301 South, Jesup, GA (US) 31599

( * ) Notice: Subject to any disclaimer, the term of this patent is extended or adjusted under 35 U.S.C. 154(b) by 334 days.

(21) Appl. No.: 10/428,634

(22) Filed: May 5, 2003

(65) Prior Publication Data

US 2004/0221857 A1 Nov. 11, 2004

(51) Int. Cl.
*A24F 47/00* (2006.01)

(52) U.S. Cl. ..... 131/273; 131/270; 131/271; 131/272; 131/330; 128/202.21

(58) Field of Classification Search ..... 131/270, 131/271, 330, 272, 273; 128/202.21
See application file for complete search history.

(56) References Cited

U.S. PATENT DOCUMENTS 3,482,580 A * 12/1969 Hollabaugh ..... 131/178
3,695,275 A 10/1972 Hayward ..... 131/171
4,184,496 A 1/1980 Adair ..... 131/170 A
4,193,411 A * 3/1980 Faris et al. ..... 131/330
4,732,167 A 3/1988 Nagano ..... 131/198.2

* cited by examiner

*Primary Examiner*—Dionne W. Mayes

(57) ABSTRACT

The Sensory Smoking Simulator (5) performs by means of suction to draw smoke (33) from a cigarette (21*a*), only a small amount of which is smelled by the user (39). It is a main body (40) that includes an air motor (12) and a vacuum pump impellers (29) operating in two separate sections (41 and 42). The lower section (42) has a window (10) to connect with the ambient air and a mouthpiece (15) that yields a bitter taste. Means is provided so that when a person (39) inhales, air is draw into the lower section (42) and through the mouthpiece (15). The upper section chamber (41) has a cigarette receiver (24) and two passageways attached, one of them (35) to exhaust the cigarette smoke to ambient air, the other one (30) to let exhaust a lesser amount of smoke (33*s*) near the user's nose (31). The smell from cigarette smoke (33*s*) and the taste secreted from the mouthpiece (15) create a mental effect similar to that of smoking, but far less harmful to a person's health.

4 Claims, 3 Drawing Sheets

SENSORY SMOKING SIMULATOR

CROSS-REFERENCE TO RELATED APPLICATIONS

Not Applicable.

BACKGROUND

1. Field of Invention

This invention relates specifically to smokers who wish to give up that habit.

2. Description of Prior Art

A lot of people try to give up the addiction to smoking every year; they focus mainly on will power, which requires a great effort by an individual. Other methods, which supply nicotine or other substances, have been tried. In most cases, several trial were required to give up that dependency.

Inventors have created several kinds of pipes to give up the craving to smoke. U.S. Pat. No. 3,695,275 to Hayward (1972) discloses a pipe, which performs as a vacuum pump to draw smoke from a cigarette and discharge it to the ambient air without the user inhaling any of that smoke. That invention stimulates the senses of tact and sight but it doesn't stimulate the sense of smell and taste as does smoking. U.S. Pat. No. 4,184,496 to Adair (1980) discloses a pipe which enables the user to circulate the air around his nose and mouth. However, this invention does not stimulate the sense of smell, sight or taste. U.S. Pat. No. 4,732,167 to Nagano (1988) discloses a pipe that allows the user to control smoke concentration. However, Nagano's invention lets the user inhale a great amount of smoke, which would cause damage to his or her health. U.S. Pat. No. 3,482,580 to Hollabaugh (1969) discloses a pipe, which produces an electrical shock in the user's lips, but this pipe draws smoke as does a regular pipe.

SUMMARY OF THE INVENTION

This invention is a Sensory Smoking Simulator, which calms the craving to smoke and reduces greatly the risk of contracting tobacco-related illnesses. It also simulates the effect of smoking, but the smoker consumes far less smoke. Thus, it provides an easy way to quit smoking.

The Sensory Smoking Simulator also performs in a superior manner than prior art, since it stimulates all of the relevant senses that the smoker associates with smoking at once: touch, smell, taste and sight.

It is, therefore, an object of the present invention to provide a novel and useful device to assist a person to give up smoking without appeal to will power.

It is a further objective of the present invention to provide a device for enabling a person to calm the craving to smoke by simulating the act of smoking, with minimal risk of catching illness caused by tobacco.

Still another object of the present invention is to provide a device that can hold a cigarette or bite burner and which allows a person to satisfy his or her craving to smoke by only smelling the aroma.

Briefly, the present invention achieves the foregoing and other objectives by a smoking device having a main body, which includes both an air motor and a vacuum pump, connected by the same shafts and performing in two separate chambers. Each chamber is connected separately to ambient air. The lower chamber has both a window on one of its sides and a mouthpiece attached on the opposite side; the upper chamber has both a cigarette receiver and two narrow exhaust pipes attached on the opposite side. The upper chamber also includes one wider exhaust pipe on top. The cigarette receiver includes both a circular opening and an adjustable air mixer valve.

In normal use, a cigarette is secured by the cigarette receiver with the mouthpiece in the smoker's mouth. Then, when a person inhales, the impellers in the lower chamber rotate and draw ambient air directly to the person's lungs through a mouthpiece while a bitter taste, similar to tobacco smoke, is being secreted by the mouthpiece. The rotation of the impeller causes the vacuum pump to rotate, which reduces the pressure in the upper chamber and draws the cigarette smoke, which is discharged to the ambient air. Most of that smoke goes, via the widest pipe, to the ambient air away from the person and the least of that smoke goes, via the narrowest pipe, to the ambient air near the user's nose. Thus, it can readily be seen that a device is provided which enables a person to simulate the act of smoking, while not actually inhaling smoke.

Other objects, aspects, and features of the invention will be apparent in the description.

The invention, accordingly, includes features of construction, a combination of elements, and the arrangement of parts, which will be shown in the Sensory Smoking Simulator herein after described.

OBJECTS AND ADVANTAGES

Accordingly, besides the objects and advantages of the Sensory Smoking Simulator described in my above patent, several objectives and advantages of the present invention are:

a) To offer an addicted smoker an easier way to quit.

b) To provide novice smokers a new way to satisfy his or her desire, with a minimum risk of impairing health.

c) To provide a pipe which involves all of the senses that are usually stimulated in tobacco smoking.

d) To provide a pipe which uses a lesser amount of tobacco to obtain a similar effect to that of ordinary smoking.

e) To provide a pipe, which could use an unlit body, that yields cigarette smoke aroma, in order to stimulate the sense of smell.

f) Permit, in places where smoking is not allowed, such as planes, cinemas, restaurants, public buildings, etc, the ability to use an unlit material which yields cigarette smoke aroma, in order to calm the craving to smoke.

g) I believe the Sensory Smoking Simulator would allow making a unique size of smokeable product, in order reduce the costs of smoking, health insurance, and government taxes, making the invention a lot more attractive to users.

Further objects of the Sensory Smoking Simulator will be brought out in the following parts of the specifications, wherein a detailed description is given for the purpose of filly disclosing the invention without placing limitations thereon.

BRIEF DESCRIPTION OF THE SEVERAL VIEWS OF THE DRAWING

With the above and other related objects in view, the Sensory Smoking Simulator consists of the details of construction and combination of parts, as will be more filly understood from the following description when read in conjunction with the accompanying drawing, in which:

FIGS. 1, 2 and 3B show the air as continues lines, and the smoke as dashed lines.

REFERENCE NUMERALS IN DRAWINGS

Figure 1:
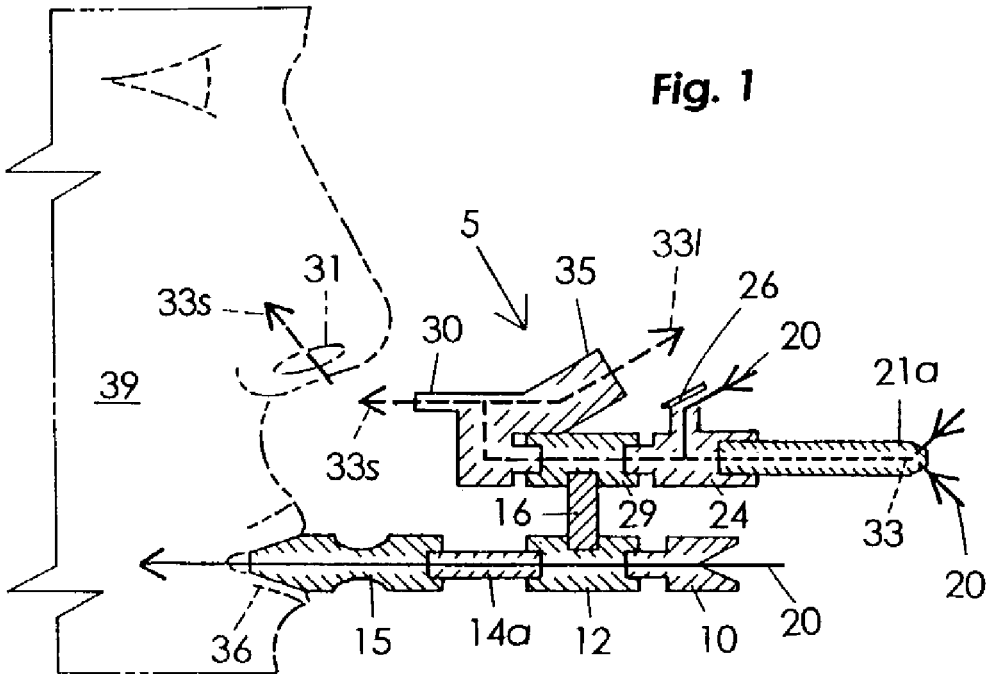
FIG. 1 shows a simplified view of my invention. I drew hatches to highlight each part.

5 Sensory Smoking Simulator 10 Screened window
12 Air motor impellers 14*a* Mouthpiece holder
14*b* Mouthpiece inner passage 15 Mouthpiece
16 Shafts 17 Electric motor
20 No contaminated air 21*a* Cigarette
21*b* Cigar holder 21*c* Pipe
21*d* Special shaped cigarette holder 21*e* Body with smoke cigarette aroma
24 Cigarette receiver 25 Damper
26 Air mixer control valve 29 Vacuum pump impellers
30 Narrowest exhaust pipes 31 Nostrils
32 Button cover 33 Smoke
33*l* Large billows of smoke 33*s* Minor billows of smoke
34 Top cover 35 Widest exhaust pipe
36 Mouth 39 Smoker
40 Main body 41 Upper chamber
42 Lower chamber 43 Chamber divider
44 Top cover slot 45*a* Slot in cigarette receiver
45*v* Slot in adjustable valve B Cutting plane line

DETAILED DESCRIPTION OF THE INVENTION

Figure 3B:
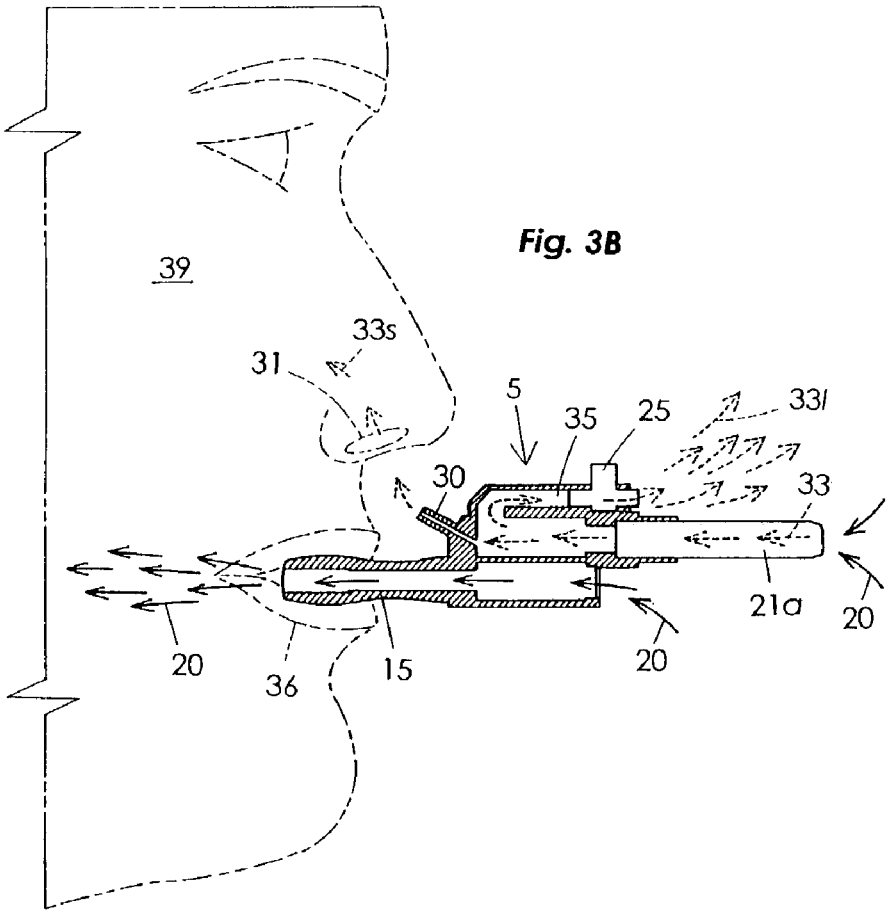
FIG. 3B shows a section view of FIG. 3A. It doesn't show the impellers and shafts.
Figure 3A:
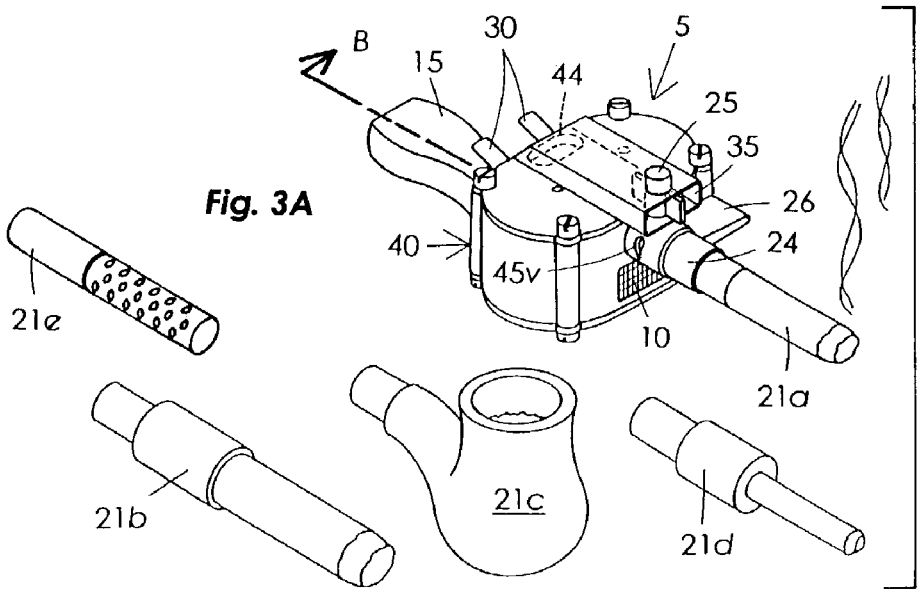
FIG. 3A shows a perspective view of an assembled pipe of my invention.
Figure 3C:
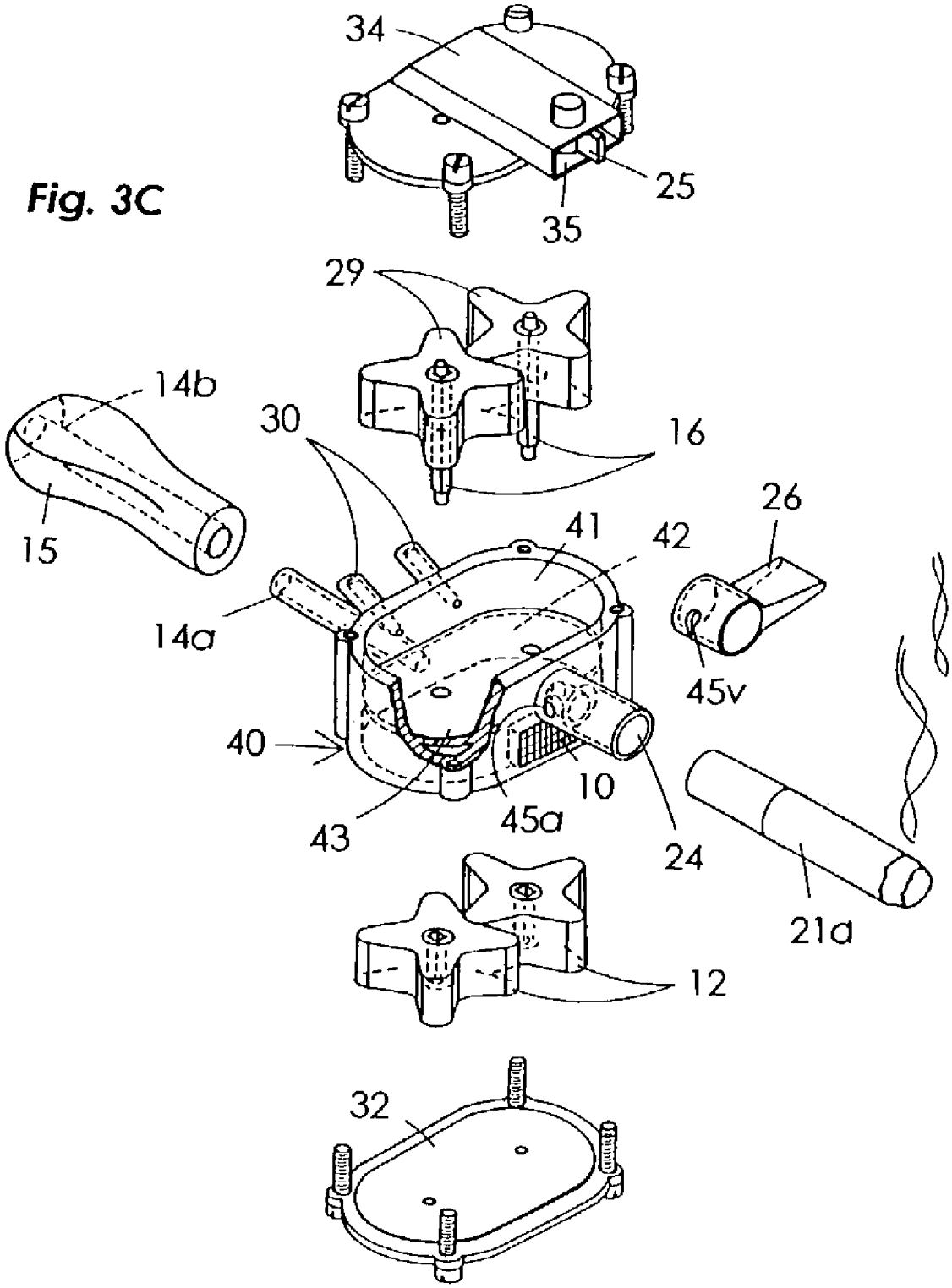
FIG. 3C shows an unassembled view of FIG. 3A.

FIGS. 3A, 3B and 3C illustrate a preferred embodiment 5 of the Sensory Smoking Simulator, according to the invention. In the present embodiment, the Sensory Smoking Simulator 5 is shown having a main body 40 that includes two chambers 41 and 42 separated by a chamber divider 43. The chamber divider is extended across the main body 40. The lower chamber 42 has a screened window 10 located on the right side of said lower chamber 42, and a mouthpiece holder 14*a*, attached on the opposite left side. A mouthpiece 15 with a bitter taste similar to tobacco smoke, which includes an inner passage 14*b*, is secured to the left end of mouthpiece holder 14*a*. Two impellers 12 perform in the lower chamber 42 as an air motor; the impellers 12 are connected by shafts 16 to the other two impellers 29, which perform in the upper chamber 41 as a vacuum pump. Shafts 16 cross through chamber divider 43. A cover 32 is secured at the bottom of the main body 40 to close up the lower chamber 42. The lower chamber 42 accesses ambient air through the screened window 10.

The upper chamber 41 has a cigarette receiver 24 attached on the right side and the two narrowest exhaust pipes 30 attached on the opposite left side. The cigarette receiver includes a slot 45*a* and a mixer air control valve 26; the mixer air control valve 26 includes a slot 45*v*. On top of the main body 40 is an attached cover 34 that includes the widest exhaust pipe 35 and a slot 44 to connect the upper chamber 41 to ambient air through the widest exhaust pipe 35. The widest exhaust pipe 35 also includes a damper 25. The top cover 34 is attached to the main body 40 to close the upper chamber 41.

It is noted that the cigarette receiver 24 might be coupled with a cigar receiver 21*b*, a special cigarette receiver 21*d*, a bite burner 21*c*, or a body with cigarette smoke aroma 21*e*, as shown in FIG. 3A.

As can be seen in the drawings, the widest exhaust pipe 35 exhausts to ambient air, opposed to the narrowest exhaust pipe 30 direction, to prevent smoke discharged via the widest exhaust pipe 35 being drawn near the nose of the user 39. In addition, the widest exhaust pipe 35 is located on top of the main body 40 to prevent smoke from being drawn into the screened window 10.

Figure 2:
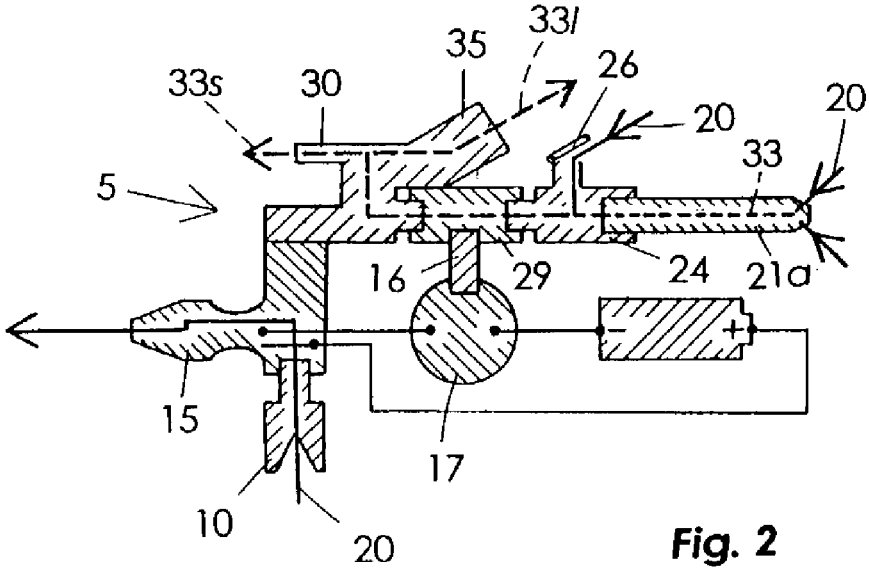
FIG. 2 shows a simplified view of an additional electrical embodiment. I drew hatches to highlight each part.

The present invention is not limited to the embodiments explained above; many modifications and alterations may be conceived within the scope of the invention. For instance, in the above embodiment, the impellers 12 rotate by air suction created when a user inhales by mouthpiece 15. However, those impellers 12 can be rotated by an electric motor 17 as shown in FIG. 2, or by any other kind of power.

Another instance in the above embodiment; an unlit body impregnated with cigarette smoke odor 21*e* could be placed in cigarette receiver 24, so that when the user inhales by mouthpiece 15, he could smell it in order to stimulate that sense.

The manner of using the Sensory Smoking Simulator 5 is identical to that of smoking using an ordinary pipe. As can be seen in FIGS. 1, 3A, 3B and 3C, a cigarette 21*a* is placed in the cigarette receiving section 24 and is lit. The user 39 then inhales through the mouthpiece 15, drawing ambient air 20 into the lower chamber 42 through the screened window 10, which causes the impellers 12 and shafts 16 to rotate. The very air that causes the impellers' rotation leaves the lower chamber 42, and via mouthpiece holder 14*a* and mouthpiece inner passage 14*b*, is directed to the user's mouth 36. As a result of shafts 16 rotating, the impellers 29 in the upper chamber 41 rotate, creating a reduced pressure in the upper chamber 41 and in the cigarette receiver 24. This creates a vacuum, drawing smoke from the cigarette 21*a* into the upper chamber 41. The majority of this smoke is discharged to the ambient air via the widest exhaust pipe 35, while a little of it is discharged to the ambient air via the narrowest exhaust pipe 30, located near the nose 31, in order that the user 39 can smell the aroma of smoke 33*s*.

In the Sensory Smoking Simulator 5, according to the invention, it is possible to adjust the amount of clean air introduced into the upper chamber 41 by adjusting the air control mixer valve 26. Thus, the concentration of the tobacco smoke 33 can be adjusted at will. In this manner, concentration of poisonous substances contained in the tobacco smoke 33 can be reduced. The Sensory Smoking Simulator also includes a damper 25 to control the exhausting air when an unlit body with cigarette smoke aroma 24 is used. Obviously, when the damper 25 is closed, the air in the upper chamber 41 is concentrated at the narrowest exhaust pipe 30. Thus, the user avoids discharging offensive odor to other people in the vicinity. Thus, it can readily be seen that said device 5 provided enables a person 39 to simulate the act or experience of smoking, while not actually inhaling smoke, lessening the danger to his health. It can be noted that, while the user 39 is inhaling no contaminated air 20 by mouthpiece 15, he stimulates the sense of touch in his respiratory system; he gets the bitter taste yielded from that mouthpiece 15; he smells the aroma of smoke 33*s*; and he may watch the device 5 performing. Thus, the user 39 experiences a mental feeling similar to that of smoking.

I claim:

1. A pipe for alleviating cravings and for simulating the smoking act, comprising:

a) a main body with one section set in the upper side of said main body, and another section set in the lower side of said main body;

b) a vacuum pump provided in said upper side section;

c) a gaseous flow passageway communicating with said upper side section;

d) an airflow pathway communicating with said lower side section;

e) a motorized means to convert energy which operates said vacuum pump;

f) an airflow, created by a pipe user, in said airflow pathway, enabling said motorized means to operate said vacuum pump;

g) a means to mechanically couple said vacuum pump with said motorized means;

h) a screen embedded at an inlet of said airflow pathway;

i) a mouthpiece holder, drilled longitudinally, embedded at an outlet of said airflow pathway;

j) a mouthpiece, coupled to said mouthpiece holder, said mouthpiece designed to be held by the pipe user's mouth, permitting said pipe user to control said airflow;

k) a holder at an inlet of said gaseous flow passageway for receiving a product which yields an aromatic substance;

l) a set of receivers, each receiver capable of being coupled to said holder, to receive an aromatic product, the aroma from said product being able to be drawn by performance of said vacuum pump;

m) an airmix control valve, coupled to said holder, for controlling the concentration of mixed air flowing through said gaseous flow passageway;

n) a first exhaust connected to an outlet of said gaseous flow passageway, for drawing the gaseous flow from said aromatic products near the nostrils of the pipe user to permit inhalation of an aromatic substance generated from said aromatic product;

o) a second exhaust, connected to said outlet of said gaseous flow passageway, with its discharging end facing outward from the pipe user, with a damper to control the capacity of a flow of said aromatic substance, from a totally open position to a totally closed position to concentrate, in said closed position, all of said flow of aromatic substance close to said nostrils, thus enabling the pipe user to inhale through the nose, said flow of aromatic substance.

2. The pipe set forth in claim 1 wherein said holder is able to receive an aromatic product selected from the group consisting of a cigarette, a cigar and a pipe.

3. The pipe set forth in claim 1 wherein said mouthpiece yields a tastable substance.

4. The pipe set forth in claim 1 wherein said motorized means comprises impellers.

* * * * *